United States Patent [19]

Kutzner et al.

[11] 4,384,672

[45] May 24, 1983

[54] DRAFT LIMITING DEVICE

[75] Inventors: Luitpold Kutzner, Bosettistrasse 8, D-8000 München 60, Fed. Rep. of Germany; Erwin Postenrieder; Falk Hellmann, both of Mering, Fed. Rep. of Germany

[73] Assignee: Luitpold Kutzner, Munich, Fed. Rep. of Germany

[21] Appl. No.: 285,986

[22] Filed: Jul. 23, 1981

[30] Foreign Application Priority Data

Aug. 8, 1980 [DE] Fed. Rep. of Germany ..... 3030131

[51] Int. Cl.[3] ..... F23N 3/02

[52] U.S. Cl. ..... 236/45; 126/292; 137/527.8

[58] Field of Search ..... 236/45; 137/527.8; 126/292; 46/29

[56] References Cited

U.S. PATENT DOCUMENTS

| | | | |
|---|---|---|---|
| 2,004,947 | 6/1935 | Irsch et al. | 236/45 |
| 2,416,468 | 2/1947 | Carsten | 236/45 X |
| 2,460,538 | 2/1949 | Schneider | 236/45 |
| 2,709,318 | 5/1955 | Benjamin | 46/29 X |
| 2,806,653 | 9/1957 | Ziph | 236/45 |
| 3,070,312 | 12/1962 | Steinen | 236/45 |
| 3,941,067 | 3/1976 | Nicolas et al. | 236/45 X |

FOREIGN PATENT DOCUMENTS

| | | | |
|---|---|---|---|
| 547391 | 5/1956 | France | 236/45 |

*Primary Examiner*—William E. Tapolcai

*Attorney, Agent, or Firm*—Toren, McGeady and Stanger

[57] ABSTRACT

A draft limiting device for controlling the draft in a flue gas passage, includes a flap which is supported on a swing shaft in a secondary air inlet for swiveling movement between a closed position, at which the flap extends in a substantially vertical plane to block entry of air from a room into the secondary air inlet, and a fully open position at which the flap is displaced a certain angle about the axis of the swing shaft to admit air through the air inlet to the flue gas passage. A solid, semi-cylindrical member is fixed to the flap so that the center of radius of the member is parallel to the swing shaft axis, and the member extends on diametrically opposite sides of the swing shaft axis. The member thereby provides a restoring moment to the flap as the flap is moved in response to a differential pressure from the closed to the open position. The magnitude of the restoring moment is either constant or decreases as the flap moves in the direction from the closed to the open position. This arrangement serves to maintain the draft in the flue gas passage at a desired value.

24 Claims, 3 Drawing Figures

DRAFT LIMITING DEVICE

BACKGROUND OF THE INVENTION

The present invention relates to a draft limiting device for a flue gas passage of a fireplace. The device includes a flap arranged to swivel about the axis of a swing shaft, and the device is located in a secondary air inlet of the flue gas passage. In response to a differential pressure which acts on the flap, the flap moves against a restoring moment from a closed position to a fully open position to admit air from a room to the flue gas passage.

Draft limiting devices are known which adjust the draft in the flue gas passage to an optimum value for a combustion process, taking into consideration that too great a draft in the flue gas passage leads to excessive combustion air. Since fresh air enters through a secondary air inlet, the draft in the flue gas passage can be reduced and thus an optimum amount of combustion air can be fed to the combustion process.

Since the draft in the flue gas passage depends on operating variables, e.g., the ambient temperature or the chimney temperature, the fresh air supply through the secondary air inlet cannot be set permanently. Rather, some control is necessary in order to keep the draft nearly constant.

Test devices are known which attempt to keep the draft in the flue gas passage nearly constant, independent of the above-mentioned variables. However, these draft limiting devices were insufficient because the desired value set for the draft, i.e., the reduced pressure which prevails at the fireplace, did not remain substantially constant, especially when the chimney draft was greater.

It was discovered that the unsatisfactory performance of the known draft limiting devices is due to the fact that the restoring moment on the flap becomes increasingly larger as the flap approaches an open position. However, when the flap is in the open position, the force which acts on the flap and which tends to deflect the flap toward the open position is at a minimum. This is true for both of the force components which originate from the static pressure differential conditions, as well as from the flow conditions. Accordingly, the known draft limiting devices open only partially because, as they move from the closed to the open position, the restoring force on the flap becomes greater while the force urging the flap toward the open position becomes increasingly smaller. The draft in the flue gas passage at the fireplace therefore does not remain constant, but increses in an undesirable manner with increasing chimney draft.

An object of the invention is to construct a draft limiting device such that an at least substantially constant draft and, consequently, a reduced pressure in the region of the fireplace can be maintained over a large range of variable operating parameters.

According to the invention, restoring means on the flap of a draft limiting device provides a restoring moment to the flap which either remains substantially constant or becomes smaller over at least a portion of the path of movement of the flap as it moves between a closed and a fully open position.

In one embodiment of a draft limiting device according to the invention, the restoring moment does not increase as the flap moves from the closed toward the open position, but remains constant or becomes smaller, so that the static and dynamic force components acting on the flap serve to move the flap further toward the open position than has been possible up to now.

It has been demonstrated that a constant effective draft at the fireplace can be achieved when the restoring moment is substantially constant for a first part of the path of movement of the flap which first part includes the closed position, and when the restoring moment becomes smaller in a second part of the path of movement which second part includes the open position.

The arrangement of the invention is not only advantageous because of the constant draft at the fireplace, but also because the restoring moment is at its highest value in the closed position of the flap. The high restoring moment permits the flap reliably to remain closed up to a desired value of the effective draft at the fireplace. Therefore, when the draft is low, i.e., below the desired value, the flap does not start to swing as in the known draft limiting devices. While in the known devices, the flap always swings open even when the chimney draft is below the value set for the draft at the fireplace, the device of the present invention is arranged to prevent the flap from swinging open under such conditions. Only when the value of the chimney draft corresponds substantially to the value set at the flap does the flap begin to swing open.

According to a preferred embodiment of the invention, the restoring moment which is effective in the closed position and the restoring moment which is effective in the fully open position can be adjusted to a great extent independently of one another. This feature has the advantage that a pressure threshold at which the flap starts to open can be set when the flap is in the closed position, and that a restoring moment still exists in the open position which, depending on the desired control function, can be set to a value which is as small as possible. This makes it possible to compensate for tolerances such as are required when the restoring moment is produced by gravitational forces and, therefore, depends on the position of the device when installed, as well as dimensional variations from production of the device.

The draft limiting device of the invention can also be constructed with return springs. Return springs with a substantially flat force characteristic are available in the form of, e.g., gas springs. Spring arrangements with a decreasing force characteristic can be realized with gear means, e.g., by the selection of the system points of the spring arrangement.

When arranging the flap as a pendulum which is supported by a horizontal swing shaft for swiveling movement between the closed and the open position, a restoring torque or moment developed by gravitational force can be used. The concept of the invention then can be easily realized by providing that the center of gravity of the flap arrangement which includes all parts fixed to the flap, lies substantially on the same level as the axis of the swing shaft in the closed position. Then, when the flap approaches the open position, the center of gravity follows a circular path, and the horizontal distance or moment arm from the center of gravity to the swing shaft axis decreases in a co-sinusoidal relation. This results in a decreasing value of the restoring moment as the flap moves toward the open position.

In the above embodiment, the value of the restoring moment which is provided in the closed position can be set in a simple manner by making the center of gravity of the flap arrangement adjustable in the horizontal direction. The restoring moment which is provided in the open position can be set by making the center of gravity of the flap arrangement adjustable in the vertical direction when the flap arrangement is viewed in the closed position.

The above two settings for the center of gravity can be implemented in a simple manner by providing an elongated arm extending transversely of and horizontally from the swing shaft (when the flap arrangement is viewed in the closed position), and a weight on the arm which can be set at a desired position along the longitudinal direction of the arm. Further, the arm is secured to the swing shaft so that it can be adjustably rotated about the axis of the swing shaft and remain fixed at a desired position relative to the swing shaft. Although the longitudinal axis of the arm need not intersect the axis of the swing shaft, it is preferable that both axes intersect one another for reasons of structural simplicity. It is also preferable that the arm face toward the room, thereby facilitating its operation and allowing the arm weight to be easily accessible.

The flap preferably is constructed so that during the change from the closed to the open position, a secondary air passage is defined between only one side of the flap and the secondary air inlet. This is contrary to the known draft limiting devices in which a secondary air passage is formed on both sides of the flap when the flap is opened. The disadvantage of the known arrangement is that an airfoil condition results from the flow of the secondary air, which adds to the restoring force as the flap opening increases. This situation does not occur with the present device which acts to maintain a constant draft at the fireplace.

The formation of a single air passage on only one side of the flap is achieved by placing the swing shaft in the region of an inside edge of the secondary air inlet. While such an arrangement might appear to make it difficult to locate the center of gravity of the closed flap arrangement on the same level as the swing shaft axis, a preferred embodiment of the present device overcomes such a problem by providing a raised shield member fixed to the flap. Therefore, when the swing shaft is arranged parallel to an inside edge of the secondary air inlet, the entry of the secondary air inlet located between the swing shaft and the inside edge always remains closed. The shield member may be in the form of, e.g., a semi-cylinder having a center of radius which coincides with the axis of the swing shaft, and having a radius which corresponds to the distance between the swing shaft axis and the adjacent inside edge of the secondary air inlet. The semi-cylinder may be arranged so that its flat outer surface which is parallel to the center of radius abuts the surface of the flap. By suitably locating the semi-cylinder, the center of gravity of the entire flap arrangement can be brought to the desired location. The shield member can be arranged, for example, so that it extends at least partly over the smaller portion of the flap which is bounded by the swing shaft, so that the shield member acts as a counterbalance weight for the remaining larger portion of the flap at the desired setting of the center of gravity.

In order to provide for fine adjustment of the center of gravity, it is preferred that the arm weight be substantially lighter than the counterbalance weight of the shield member. Accordingly, fine adjustment of the center of gravity is achieved easily by moving the arm weight over relatively large distances along the arm.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described preferred embodiments of the invention.

DETAILED DESCRIPTION OF THE INVENTION

Figure 1:
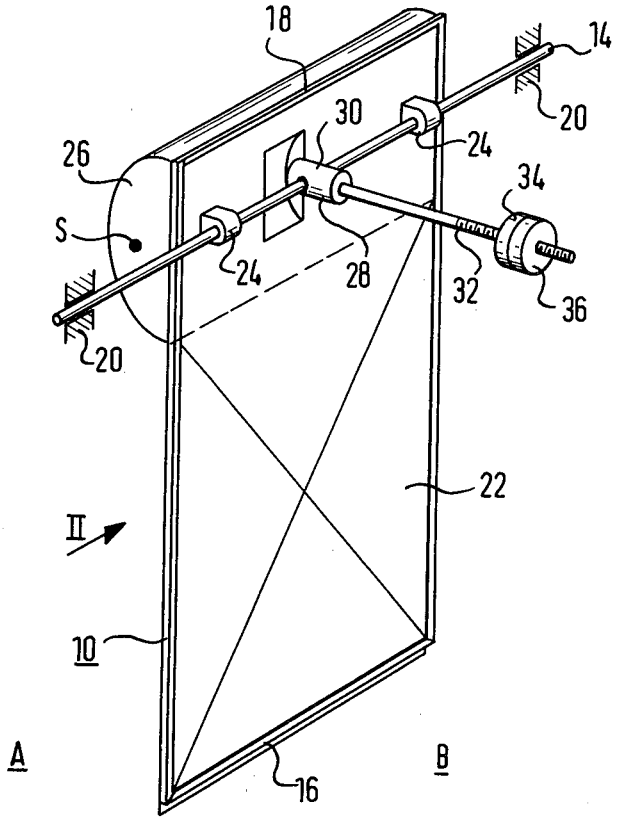
FIG. 1 shows a perspective view of a draft limiting device including a flap according to the invention.

FIG. 1 shows a frame 10 of a draft limiting device according to the invention. Frame 10 includes a bottom inside edge 16 and a top inside edge 18. The frame 10 is placed into a secondary air inlet (not shown) which can be provided in, e.g., a chimney side wall, or a flue gas pipe between a fireplace and a chimney. The side of the device which faces the flue gas is identified by A, and the side facing the room, i.e., the room in which the fireplace is located, is identified by B.

A horizontal swing shaft 14 is arranged at the frame 10 and is spaced further apart from the bottom inside edge 16 of the frame 10 than from the top inside edge 18. The swing shaft 14 is supported for rotation in bearings 20 which are fixed to the frame 10 by means not shown in the drawing. The shaft 14 is fixed to a flap 22 at two locations 24. The perimeter of the flap 22 corresponds to the inner boundary of the frame 10.

Figure 2:
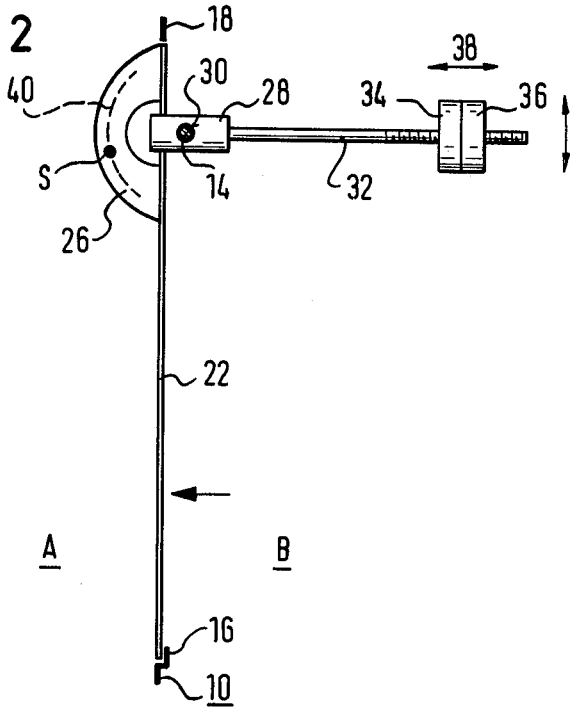
FIG. 2 is an end view of the device looking in the direction of arrow II in FIG. 1 while the flap is in a closed position.

As shown in FIG. 2, the frame 10 forms a stop for the flap 22 at the bottom edge 16, so that the flap 22 can be rotated only clockwise from the closed position as viewed in FIG. 2.

A generally semi-cylindrical shield member 26 is arranged on the flap 22 so that the axis of the shield member 26 is substantially parallel to that of the swing shaft 14, and the shield member 26 extends on diametrically opposite sides of the axis of the swing shaft 14. Shield member 26 preferably is solidly formed of metal. The mass of the semi-cylindrical shield member 26 causes the center of gravity S of the entire swinging flap arrangement including the flap 22 and all parts fixed to the flap 22 to lie substantially at the same level as the swing shaft 14, as shown in FIGS. 1 and 2. Therefore, the shield member 26 serves as a counterbalance weight in addition to other functions, discussed below.

A bearing bush 28 having a cross bore 30 is arranged on the swing shaft 14. The swing shaft 14 is held in the cross bore 30 with a friction fit, so that the bearing bush 28 can be forcibly rotated about the axis of the swing shaft 14, but will remain in a fixed position relative to the swing shaft once the bearing bush 28 has been set in such position. A threaded spindle 32 is fixed at one end to the bearing bush 28. Two setting weights 34,36 threadably engage the spindle 32 and are arranged for movement along the spindle 32 in the direction of the double arrow 38. The weights 34,36 can be effectively locked together at a desired position along the spindle 32.

When a reduced pressure condition exists on the flue gas side A due to a chimney draft, then a differential in pressure develops on both sides of the flap 22 between the reduced pressure on side A and the room pressure on side B. This differential pressure causes the flap 22 to open by rotating clockwise as viewed in FIG. 2. During opening movement of the flap 22, the center of gravity S of the flap arrangement moves along a circular path 40 which is identified with dash lines in FIG. 2.

Starting with the position of the center of gravity S shown in FIG. 2, it can be seen that when the flap 22 is moved, the horizontal distance between the center of gravity S and the axis of the swing shaft 14 increases only very slightly until the center of gravity S is exactly level with the axis of the swing shaft 14. From this point on, the horizontal distance between the center of gravity S and the axis of swing shaft 14 decreases. This means that the restoring moment which acts on the swinging flap arrangement and stems from the center of gravity S becomes smaller with increasing deflection of the flap 22 toward the open position.

The restoring moment which urges the flap 22 against the bottom edge 16 at the closed position of FIG. 2 depends on the position of the setting weights 34,36. The further the setting weights 34,36 are moved to the left in FIG. 2, the further the center of gravity S is moved to the left and the greater the restoring moment on the flap 22 at the closed position of FIG. 2. In this way, a threshold pressure can be set at which the flap 22 begins to open.

Figure 3:
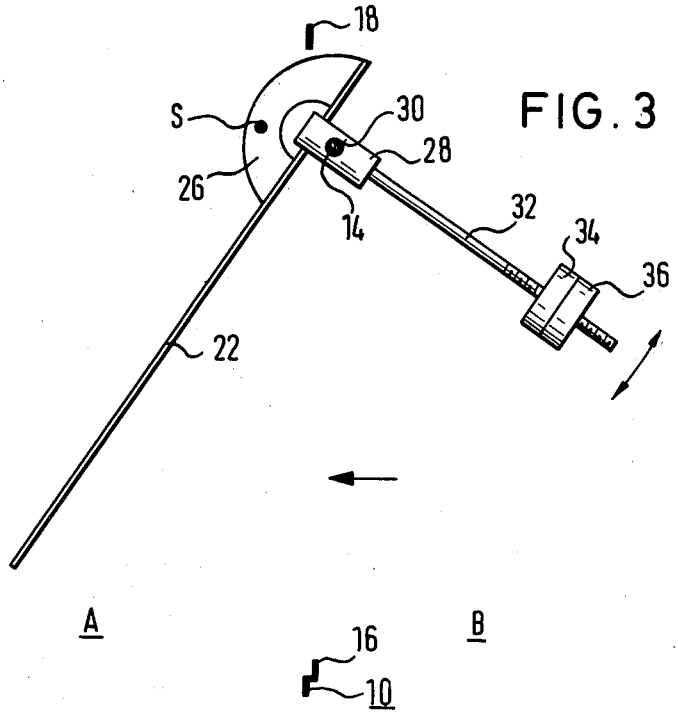
FIG. 3 is a view similar to FIG. 2 showing the flap in a partially open position.

FIG. 3 shows the flap 22 in a partially open position. The center of gravity S is moved upwardly and to the right relative to its position in FIG. 2, so that the restoring moment which tends to swing the flap 22 back toward the bottom edge 16 of frame 10 becomes smaller.

The restoring moment can be changed by swiveling the bearing bush 28 about the axis of the swing shaft 14 either upwardly or downwardly. Accordingly, when the flap 22 approaches a horizontal position during continued opening movement, it will be subjected to a restoring moment which is as small as possible. By swiveling the bearing bush 28 about the axis of the swing shaft 14, balancing can be achieved even when the frame 10 is installed in a position such that the frame 10 lies in a plane which deviates from the vertical direction.

In the draft limiting device according to the invention, less than the entire open cross-section of the frame 10 is used to admit secondary air to the flue gas passage, since a part of the air passage is always closed by the shield member 26 (compare FIGS. 1 and 3). However, the flap 22 can swing open over a much greater angle about the swing shaft axis than in the known devices, so that the present draft limiting device occupies less space in which it can be easily installed. Further, material costs are reduced.

It may be desirable to move the swing shaft 14 further to the right as viewed in FIG. 2, and to reshape the outer periphery of the shield member 26 accordingly, while leaving the present device otherwise unchanged. If the horizontal distance between the swing shaft 14 and the plane of the frame 10 is equal to the vertical distance between the swing shaft 14 and the top inside edge 18, then the total frame cross-section is available as a flow passage when the flap 22 is swung 90° from the position of FIG. 2.

While specific embodiments of the invention have been shown and described in detail to illustrate the application of the inventive principles, it will be understood that the invention may be embodied otherwise without departing from such principles.

As can be seen from FIG. 2 the center of gravity S is in vertical direction, slightly below the axis of the shaft 14 in the closed condition. The horizontal distance of the center of gravity S from the axis of the shaft 14 defines a predetermined initial closing torque exerted onto the flap arrangement. When the flap arrangement is rotated towards the position of FIG. 3, the horizontal distance of the center of gravity S for the axis of the shaft 14 is increased only slightly until a maximum horizontal distance is achieved, when the center of gravity S is exactly on the same height level than the axis of the shaft 14. So also the closing torque is only increased slightly. On further rotation in the clockwise sense, the horizontal distance of the center of gravity S from the axis of the shaft 14 is decreased again and correspondingly the closing torque also decreases again. It is essential for this invention that the increase of the closing torque from the initial value existing in the closed position of FIG. 2 to the maximum value existing when the center of gravity S is on the level of the axis of the shaft 14 is less than 40% of the initial value of the closing torque, preferably less than 20% and still more preferably less than 10%.

The center of the shield member 26 substantially coincides with the axis of the shaft 14.

What is claimed is:

1. A draft limiting device for controlling the draft in a flue gas passage by admitting air from a room through a secondary air inlet to the flue gas passage, comprising a flap, frame means for forming a transverse cross-section of the secondary air inlet and for supporting said flap in the secondary air inlet, means including a swing shaft associated with said flap for enabling swivelling movement of said flap about the axis of said swing shaft between a closed position at which said flap prevents air from entering the secondary air inlet and a fully open position at which said flap allows air from the room to be admitted through the secondary air inlet, restoring means on said flap for providing a restoring moment to said flap about the axis of said swing shaft when said flap is moved in response to differential pressure over a path between said closed position and said fully open position for urging said flap toward said closed position, said restoring means being arranged so that said restoring moment is of a magnitude which is either substantially constant or decreases as said flap moves over at least a part of said path from said closed position toward said fully open position, wherein said flap, said frame means, said swing shaft and said restoring means are arranged so that a secondary air passage is provided within the secondary air inlet, the secondary air passage having a transverse cross-section which extends between only one side of said swing shaft and a portion of said frame means when said flap moves between said closed and said fully open positions, and a raised shield member on said flap for closing the transverse cross-section of the secondary air inlet which extends between the diametrically opposed side of said swing shaft and the remaining portion of said frame means when said flap moves between said closed and said fully open positions, wherein said shield member is generally semi-cylindrical in shape and has a center of radius which substantially coincides with the axis of said swing shaft, said frame means includes an inside top edge which extends parallel to the axis of said swing shaft, and the radius of said shield member corresponds to the distance between said swing shaft and said inside top edge of said frame means so that the outer circumferential surface of said shield member remains closely adjacent to said inside top edge when said flap moves between said closed and said fully open positions.

2. A draft limiting device according to claim 1, wherein said shield member abuts said flap along a planar surface on said shield member which surface is parallel to the center of radius of said shield member.

3. A draft limiting device for controlling the draft in a flue gas passage by admitting air from a room through a secondary air inlet to the flue gas passage, comprising a flap, frame means for forming a transverse cross-section of the secondary air inlet and for supporting said flap in the secondary air inlet, means including a swing shaft associated with said flap for enabling swivelling movement of said flap about the axis of said swing shaft between a closed position at which said flap prevents air from entering the secondary air inlet and a fully open position at which said flap allows air from the room to be admitted through the secondary air inlet, restoring means on said flap for providing a restoring moment to said flap about the axis of said swing shaft when said flap is moved in response to differential pressure over a path between said closed position and said fully open position for urging said flap toward said closed position, said restoring means being arranged so that said restoring moment is of a magnitude which is either substantially constant or decreases as said flap moves over at least a part of said path from said closed position toward said fully open position, wherein said flap, said frame means, said swing shaft and said restoring means are arranged so that a secondary air passage is provided within the secondary air inlet, the secondary air passage having a transverse cross-section which extends between only one side of said swing shaft and a portion of said frame means when said flap moves between said closed and said fully open positions, and a raised shield member on said flap for closing the transverse cross-section of the secondary air inlet which extends between the diametrically opposed side of said swing shaft and the remaining portion of said frame means when said flap moves between said closed and said fully open positions, wherein said frame means includes an inside top edge and an inside bottom edge, both of said edges extending parallel to the axis of said swing shaft and said swing shaft is located closer to said inside top edge than to said inside bottom edge to define a smaller flap part which extends between said swing shaft and said inside top edge and a larger flap part which extends between said swing shaft and said inside bottom edge, and at least a part of said shield member extends over said smaller part for providing a counterbalance weight for the larger flap part, said shield member forming a part of said restoring means, wherein said restoring moment is provided by gravitational force.

4. A draft limiting device according to claim 3, including an elongated arm connected for movement with said flap and extending substantially horizontally from said flap when said flap is in said closed position, at least one weight on said arm, said weight being arranged for adjustable movement in the longitudinal direction of said arm, and bush means fitted on said swing shaft for securing one end of said arm and fixing said arm at a desired position about the axis of said swing shaft, said at least one weight on said arm being substantially lighter than said counterbalance weight provided by said shield member for providing fine adjustment of the center of gravity of said flap and all parts connected for movement with said flap when said at least one weight is moved in the long direction of said arm.

5. A draft limiting device for controlling the draft in a flue gas passage by admitting air from a room through a secondary air inlet to the flue gas passage, comprising a flap, said flap being mounted for swivelling movement about a swing axis between a closed position at which said flap substantially prevents air from entering the secondary air inlet and a fully open position at which said flap allows air from the room to be admitted through the secondary air inlet, restoring means associated with said flap for providing a restoring moment to said flap about said swing axis when said flap is moved in response to differential pressure over a path between said closed position and said fully open position for urging said flap toward said closed position, said secondary air inlet having a transverse cross-section which is subdivided by said swing axis into two inlet portions wherein a first one of said two inlet portions defines a secondary air passage when said flap is moved toward said fully open position, and a three-dimensional shield member fixed for movement together with said flap, said shield member having a curvilinear surface which at least partly circumscribes said swing axis, the generatrix of said curvilinear surface corresponding substantially to the borderline of the secondary air inlet which defines said second inlet portion so that said second inlet portion is closed as said flap swivels over at least part of said path of movement from said closed position toward said fully open position.

6. A draft limiting device as set forth in claim 5, wherein said shield member is generally semi-cylindrical in shape.

7. A draft limiting device as set forth in claim 5, including shaft means for defining said swing axis as substantially horizontal in space.

8. A draft limiting device as set forth in claim 5, wherein the area of said first inlet portion is larger than that of said second inlet portion.

9. A draft limiting device as set forth in claim 7, wherein said first inlet portion is located below said swing axis.

10. A draft limiting device as set forth in claim 5, wherein said shield member forms at least a part of said restoring means, said restoring moment being provided by gravitational force.

11. A draft limiting device as set forth in claim 5, said restoring means being arranged so that said restoring moment is of a magnitude which is either substantially constant or decreases as said flap moves over at least a part of said path from said closed position toward said fully open position.

12. A draft limiting device as set forth in claim 5, including a swing shaft associated with said flap for enabling said swivelling movement of said flap about said swing axis.

13. A draft limiting device as set forth in claim 11, wherein said restoring means is arranged so that said restoring moment is substantially constant as said flap moves over a first part of the path of movement of said flap including said closed position, and said restoring moment decreases as said flap moves toward said open position over a second part of the path of said flap including said open position.

14. A draft limiting device as set forth in claim 5, including first means arranged to move with said flap for adjusting said restoring moment to a first value when said flap is in said closed position, and second means for adjusting said restoring moment to a second value, independently of said first value, when said flap is in said open position.

15. A draft limiting device as set forth in claim 14, including a swing shaft for defining said swing axis, wherein the axis of said swing shaft is substantially horizontal, and the center of gravity of said flap and parts connected for movement with said flap including said first and second means is at substantially the same level as the axis of said swing shaft so that said restoring moment is provided by gravitational force.

16. A draft limiting device as set forth in claim 15, wherein said first means is arranged to displace said center of gravity in the horizontal direction relative to the axis of said swing shaft and when said flap is in the closed position for adjusting said first value of said restoring moment.

17. A draft limiting device as set forth in claim 16, wherein said second means is arranged to displace said center of gravity in the vertical direction relative to the axis of said swing shaft and when said flap is in the open position for adjusting said second value of said restoring moment.

18. A draft limiting device as set forth in claim 17, said first means including an elongated arm connected for movement with said flap and extending perpendicularly from said flap when said flap is in said closed position, at least one weight on said arm, said weight being arranged for adjustable movement in the longitudinal direction of said arm, and bush means fitted on said swing shaft for securing one end of said arm and fixing said arm at a desired position about the axis of said swing shaft.

19. A draft limiting device as set forth in claim 18, wherein said arm extends from the side of said flap which side faces in the direction of the room when said flap is in said closed position.

20. A draft limiting device as set forth in claim 5, including a frame arranged at said secondary air inlet, and said flap is mounted on said frame for swinging movement with respect to said frame.

21. A draft limiting device as set forth in claim 6, wherein said shield member abuts said flap along a planar surface on said shield member which surface is parallel to the center of radius of said shield member.

22. A draft limiting device as set forth in claim 12, including an elongated arm connected for movement with said flap and extending substantially horizontally from said flap when said flap is in said closed position, at least one weight on said arm, said weight being arranged for adjustable movement in the longitudinal direction of said arm, and bush means fitted on said swing shaft for securing one end of said arm and fixing said arm at a desired position about the axis of said swing shaft, said at least one weight on said arm being substantially lighter than said counterbalance weight provided by said shield member for providing fine adjustment of the center of gravity of said flap and all parts connected for movement with said flap when said at least one weight is moved in the long direction of said arm.

23. A draft limiting device as set forth in claim 12, wherein said swing shaft is fixed to said flap so that the axis of said swing shaft extends parallel to the surface of said flap, and including bearing means for engaging said swing shaft to enable the swiveling movement of said flap.

24. A draft limiting device as set forth in claim 23, wherein said bearing means comprises a number of bearing members each supported in fixed relation with respect to the secondary air inlet.

* * * * *